US010947097B2

(12) United States Patent
Clifton

(10) Patent No.: US 10,947,097 B2
(45) Date of Patent: Mar. 16, 2021

(54) RAPID BEVERAGE CONSUMPTION DEVICE

(71) Applicant: Amanda Clifton, Alexandria, VA (US)

(72) Inventor: Amanda Clifton, Alexandria, VA (US)

( * ) Notice: Subject to any disclaimer, the term of this patent is extended or adjusted under 35 U.S.C. 154(b) by 0 days.

(21) Appl. No.: 16/606,600

(22) PCT Filed: Apr. 9, 2019

(86) PCT No.: PCT/US2019/026643
§ 371 (c)(1),
(2) Date: Oct. 18, 2019

(87) PCT Pub. No.: WO2019/199872
PCT Pub. Date: Oct. 17, 2019

(65) Prior Publication Data
US 2021/0039936 A1 Feb. 11, 2021

Related U.S. Application Data

(60) Provisional application No. 62/654,716, filed on Apr. 9, 2018.

(51) Int. Cl.
*B67B 7/86* (2006.01)

(52) U.S. Cl.
CPC ..... *B67B 7/28* (2013.01)

(58) Field of Classification Search
CPC ..... B67B 7/28; B67B 7/26; B67B 7/24
See application file for complete search history.

(56) References Cited

U.S. PATENT DOCUMENTS 2,049,541 A 8/1936 Hatchel
2,582,660 A * 1/1952 Thomas ..... B67B 7/28 222/83.5
2,655,858 A 10/1953 Hamlin
2,718,054 A * 9/1955 Korda ..... B67B 7/24 30/448
2,721,380 A * 10/1955 Gagnon ..... B67B 7/24 30/447
2,746,645 A * 5/1956 Knabel ..... B67B 7/28 222/86
2,846,120 A * 8/1958 Strean ..... B67B 7/26 222/86
2,895,653 A * 7/1959 Giepen ..... G01F 11/28 222/452
3,052,978 A 9/1962 Newman
3,184,110 A * 5/1965 Gombar ..... A47J 36/14 222/86

(Continued)

OTHER PUBLICATIONS

Beer Blaster Product Test & Review, https://www.youtube.com/watch?v=02hXou5J_JA, Jul. 14, 2019, 1:40-2:08.

(Continued)

*Primary Examiner* — Donnell A Long
(74) *Attorney, Agent, or Firm* — Caesar Rivise, PC

(57) ABSTRACT

A Rapid Beverage Consumption Device operating to provide consistent dual puncturing of a beverage container, without direct exposure of a user to sharp piercing elements, ventilated flow of the beverage contents via a predetermined path, and leak resistance for quick consumption of the beverage and avoidance of spillage, thereby reducing waste, reducing the likelihood of the user getting wet and for providing entertainment to the user.

15 Claims, 4 Drawing Sheets

(56) References Cited

U.S. PATENT DOCUMENTS 3,217,929 A * 11/1965 Cole ..... B67B 7/28 222/83.5
3,784,059 A * 1/1974 Katzakian ..... B67B 7/28 222/86
3,926,339 A * 12/1975 Openchowski ..... B67D 3/00 222/83
4,079,862 A * 3/1978 Fegley ..... B65D 83/267 222/162
5,224,619 A * 7/1993 Dilworth ..... A47G 19/12 220/277
5,292,021 A * 3/1994 Lyon ..... A47G 23/0258 220/253
5,823,236 A * 10/1998 Kirby ..... B67B 7/28 141/330
6,554,165 B2 4/2003 Cote
8,387,264 B1 3/2013 Pritchard
9,856,123 B1 * 1/2018 Mantz ..... B65D 17/02
2004/0056033 A1 * 3/2004 Bohlman ..... B67B 7/24 220/278
2012/0118993 A1 * 5/2012 Colosio ..... A61L 9/037 239/34
2014/0250700 A1 * 9/2014 Liotta ..... B26F 1/32 30/366
2015/0274499 A1 * 10/2015 Simpson ..... B67B 7/28 141/332
2018/0185874 A1 * 7/2018 Lee, III ..... B05C 17/0123
2018/0334370 A1 * 11/2018 Harlow ..... B67B 7/24
2019/0069700 A1 * 3/2019 Stirbis ..... A47G 19/22
2019/0202678 A1 * 7/2019 Lager ..... B67B 7/24
2019/0218087 A1 * 7/2019 Clark ..... A47G 21/18
2019/0225472 A1 * 7/2019 Abreu ..... B67B 7/24

OTHER PUBLICATIONS

International Search Report for corresponding PCT Application No. PCT/US19/24463 dated Jun. 26, 2019.

* cited by examiner

FIG. 5
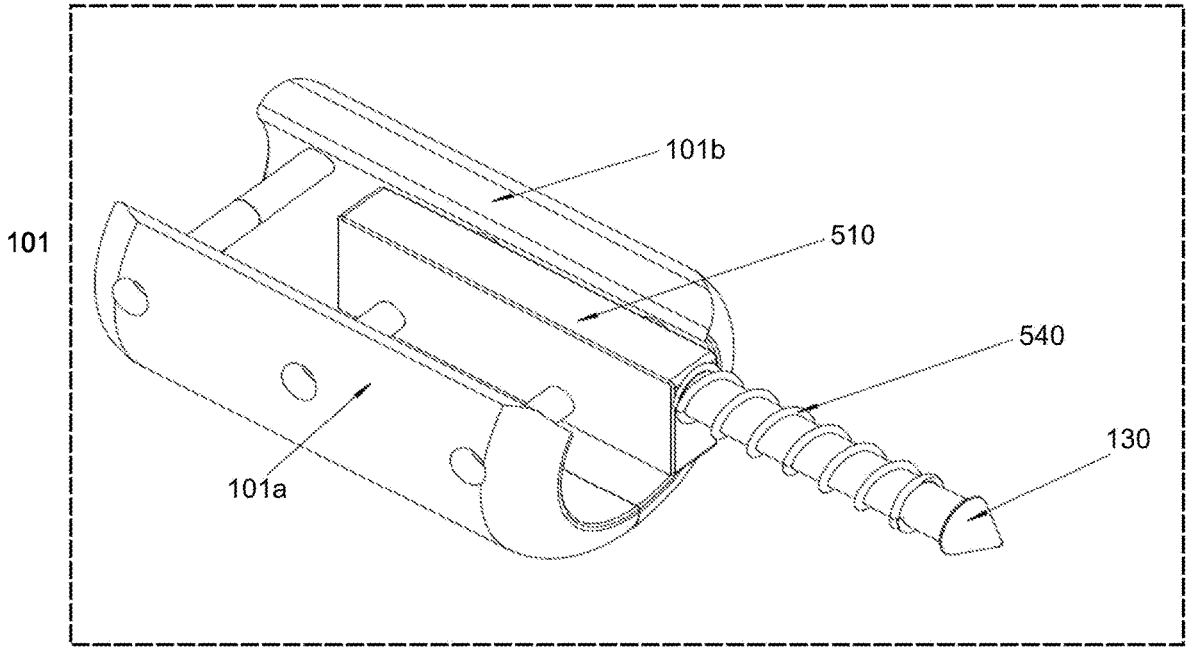
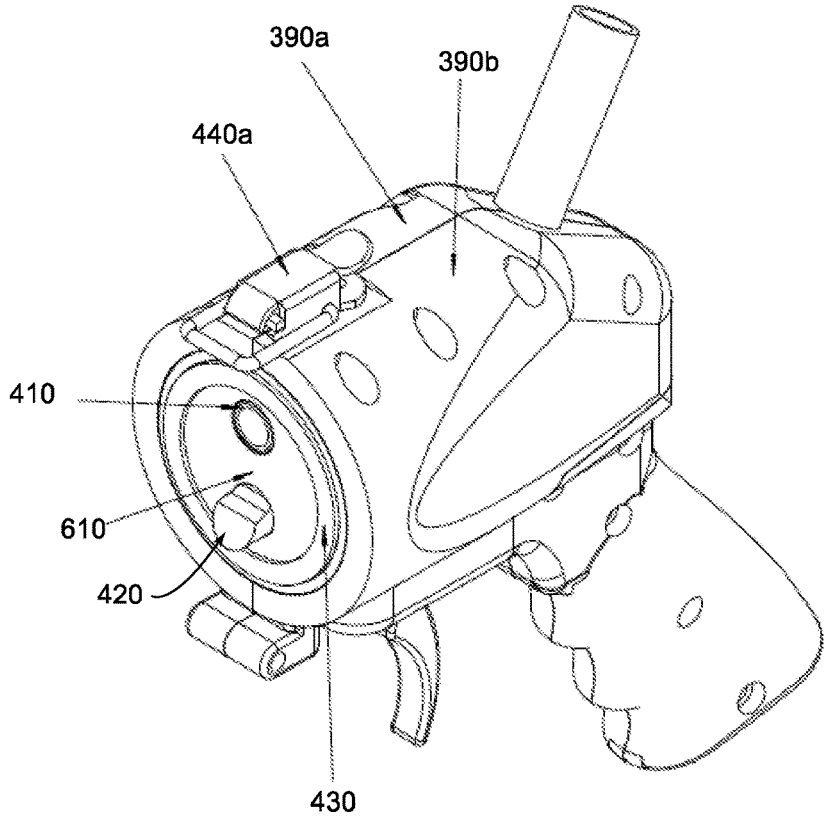
FIG. 6

RAPID BEVERAGE CONSUMPTION DEVICE

CROSS REFERENCE TO RELATED APPLICATION

This United States national phase application claims the benefit under 35 U.S.C. § 371 of PCT Application No. PCT/US19/26643 filed on Apr. 9, 2019, which in turn claims priority under 35 U.S.C. § 119(e) of U.S. Provisional Patent Application Ser. No. 62/654,716, filed on Apr. 8, 2018, whose entire disclosures are incorporated by reference herein in their entirety.

BACKGROUND OF THE INVENTION

The invention described herein relates generally to apparatus for dispensing a beverage for consumption by a user of the apparatus. More particularly, the present invention relates to apparatus for dually puncturing a beverage container in an enclosed portion of the apparatus and rapidly delivering to the user of the apparatus the beverage from the container via a mouthpiece of the apparatus.

BACKGROUND

The activity of "shotgunning" a beer is a method of entertainment wherein a person consumes a beverage, such as beer, soda, juice, or seltzer, as rapidly as possible. The general method of shotgunning involves the shotgunner holding a beverage—usually provided in a can—parallel to the ground. The individual then utilizes a sharp object, such as a key or other common object, to puncture the side or bottom of the can while, simultaneously, opening the pop tab of the can (or other sealing means of other types of containers, such as the cap of a plastic bottle). The individual then quickly brings the beverage container to his or her mouth, turning the can upright and placing his or her mouth around the opening created by the puncturing step. The venting action created by the dual openings permits rapid flow of the beverage into the user's mouth, allowing the entertaining act of consuming the beverage as quickly as possible.

While this activity is well-known, it is fraught with opportunities for mishap, including wounding oneself while puncturing the container, dropping the container, drenching oneself when pressurized contents escape from the unstable container, or—in the worst case with respect to satisfaction and social status—spilling significant amounts of the beverage either from the open top of the can or the puncture point due to pressure build-up and/or incomplete sealing of the opening by use of the mouth.

The need therefore remains for a device that will make shotgunning easier, less messy, safer, and more consistent.

All references cited herein are incorporated herein by reference in their entireties.

BRIEF SUMMARY OF THE INVENTION

It is broadly desirable to provide an apparatus to permit rapid consumption of a beverage in an action akin to shotgunning that does not require manual handling of a puncturing device, avoids spraying the user with the beverage, and significantly reduces spillage, all by repeatable operation of an enclosed device that receives the beverage container.

Specifically, it is contemplated by the present invention to provide an apparatus that internally receives a beverage container and creates a seal between the receiving portion of the device and the container. Piercing components are arranged for operation, as more fully described herein, to safely puncture the container inside the device and permit rapid escape of the beverage contents, which then may flow by a provided path to an outlet on which the user of the devices places his or her mouth and enjoys the delivery of the beverage for rapid consumption.

Some exemplary embodiments of the present invention further provide the apparatus in a shape with the appearance of a shotgun, adding to the novelty of the apparatus and increasing the likelihood that users will quote action movie legends at your party.

The components of the device generally comprise an enclosed beverage container receiving portion, a trigger-operated puncturing mechanism, a trigger assembly, at least one vent, a second puncturing mechanism, which may be operable in various ways in accordance with various embodiments, a flow path, and a mouthpiece.

The invention provides a unique means of rapidly dispensing a beverage for entertainment purposes.

BRIEF DESCRIPTION OF THE DRAWINGS

FIG. 5 is a perspective view of an exemplary slide assembly.

FIG. 6 is a perspective view of an exemplary handle assembly.

DETAILED DESCRIPTION OF THE INVENTION

The invention of the present disclosure is described below with reference to certain embodiments. While these embodiments are set forth in order to provide a thorough and enabling description of the invention, these embodiments are not set forth with the intent to limit the scope of the disclosure. A person of skill in the art will understand that the invention may be practiced in numerous embodiments, of which those detailed here are merely examples. In order to allow for clarity of the disclosure of the claimed invention, structures and functions well known to those skilled in the art are not here disclosed. Those skilled in the art should also realize that equivalent Rapid Beverage Consumption Devices do not depart from the spirit and scope of the invention in its broadest form.

Specifically, it is contemplated by the present invention to provide a Rapid Beverage Consumption Device generally comprising:

A container receiver that accepts a beverage container;

Dual piercing mechanisms, at least one operated by a trigger assembly mechanism and the other either manually operated—such as by sliding—or also mechanically triggered;

A trigger assembly;

A forestock, which may further comprise a barrel and a slide;

At least one vent;

A mouthpiece for drinking the beverage; and

An internal path for the flow of the beverage from a pierced container in the container receiver to the mouthpiece for drinking by the user.

The components of the system are operated in accordance with the several disclosed embodiments, or other embodiments as described and claimed, in order to create two openings in a beverage container and rapidly deliver the contents of the pierced beverage container to a user of the apparatus, smoothly, neatly, without direct exposure to piercing mechanisms and for maximum entertainment.

Figure 1:
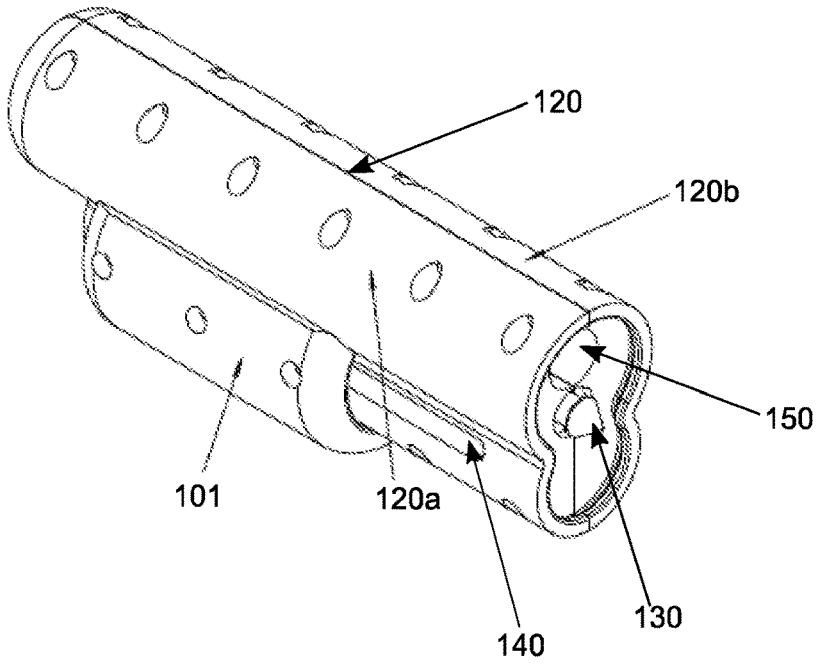
FIG. 1 is a perspective view of a forestock.

In one exemplary embodiment of the present invention, the apparatus is designed and constructed to include a forestock and handle. Referring now to FIG. 1, an exemplary forestock is illustrated. The forestock is comprised of a barrel 120 having a forward vent 150, a first piercer 130, and a slide 101. The slide 101 is designed to move independently of the barrel 120, as further described.

The barrel 120 may be manufactured in multiple pieces, such as 120*a* and 120*b*, by known methods such as various plastic molding methods, and assembled to form the barrel 120 by snapping, screwing, or otherwise fastening the multiple pieces together. One of skill in the art will understand that many other materials and manufacturing methods may be used to form the barrel 120 and any of the various elements described herein, including, without limitation, injection molding (such as of various plastics), metal forming, composite manufacturing and additive manufacturing (aka "3D printing"). Disposed on the barrel is a slide 101, to which is engaged a first piercer 130, which first piercer further is arranged to be inside of the barrel 120. The pump slide 101 is engaged so as to be manually operable along a length of the barrel 120, such as by sliding. This operation of the slide 101 causes the first piercer 130 to travel along a path substantially parallel to a length of the barrel 120, permitting the first piercer 130 to enter a container receiver portion of the apparatus, further described herein. Forward vent 150 permits air from inside the length of the barrel 120 to flow into or out of the container receiver. In some embodiments, such as shown in FIG. 1, the barrel 120 may be formed to include a guide for the travel of the slide 101, such as the channel 140. While the slide 101 shown is manually operable, it may be arranged for mechanical triggering, such as by the use of spring-loaded triggers of various design.

Connection of the slide 101 to the barrel 120, or otherwise placing these elements in physical communication so as to permit the slide 101 to move along a length of the barrel 120, may be accomplished through various arrangements. One example utilizes a slide having a shape presenting an inner diameter or inner perimeter that can be coupled to the outer diameter or outer perimeter of at least a portion of the barrel, permitting them to be engaged with one another. Contouring of the portion of the slide 101 that engages the barrel 120 could, for instance, have a ridge or lip that can be engaged with a recess on the engaged portion of the barrel. The channel 140 shown may act as such recess. Such arrangement would permit the portion of the barrel to pass through the inner area of the slide as the slide is moved, but the lip or ridge of the slide would preclude the slide from exiting the recess of the barrel. Another example might provide for sliding the slide onto the length of the barrel from one end of the barrel and then placing a retaining member on said end as part of the assembly process. This would permit the slide to move along the length of the barrel but not to be removed or to fall off.

Figure 2:
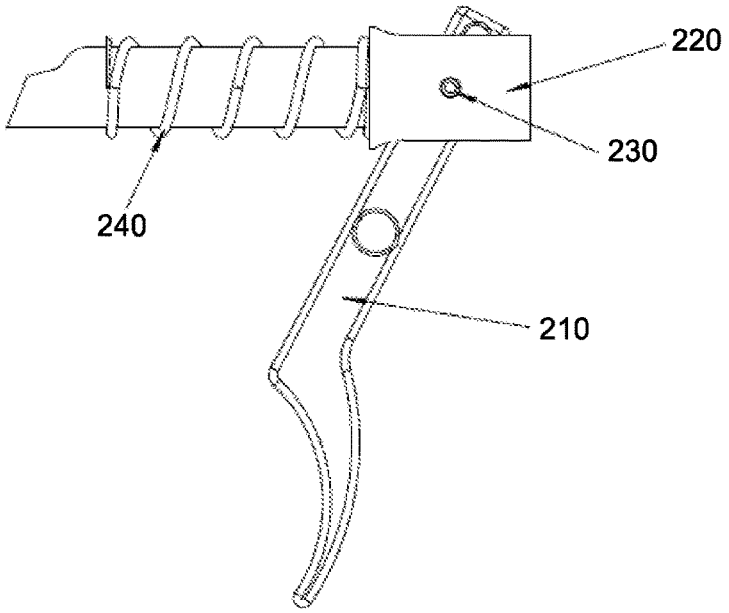
FIG. 2 is a plan view of a trigger assembly.

Turning now to FIG. 2, there is shown a trigger assembly comprising a trigger 210, a trigger piercer 220, a spring pin 230, and a spring 240. The spring 240 is disposed along a length of the trigger piercer 220. Spring pin 230 acts as a hinge upon which the trigger piercer 220 and trigger 210 may rotate. This permits the operation of trigger 210, when the trigger assembly is engaged with the complete apparatus of the present invention, to cause the trigger piercer 220 to travel in a forward direction, operating to pierce a beverage container in the container receiver. Well understood spring action permits the trigger 210 and trigger piercer 220 to accomplish the forceful piercing of the beverage container and to return the trigger assembly portions to their original, resting positions.

Figure 3:
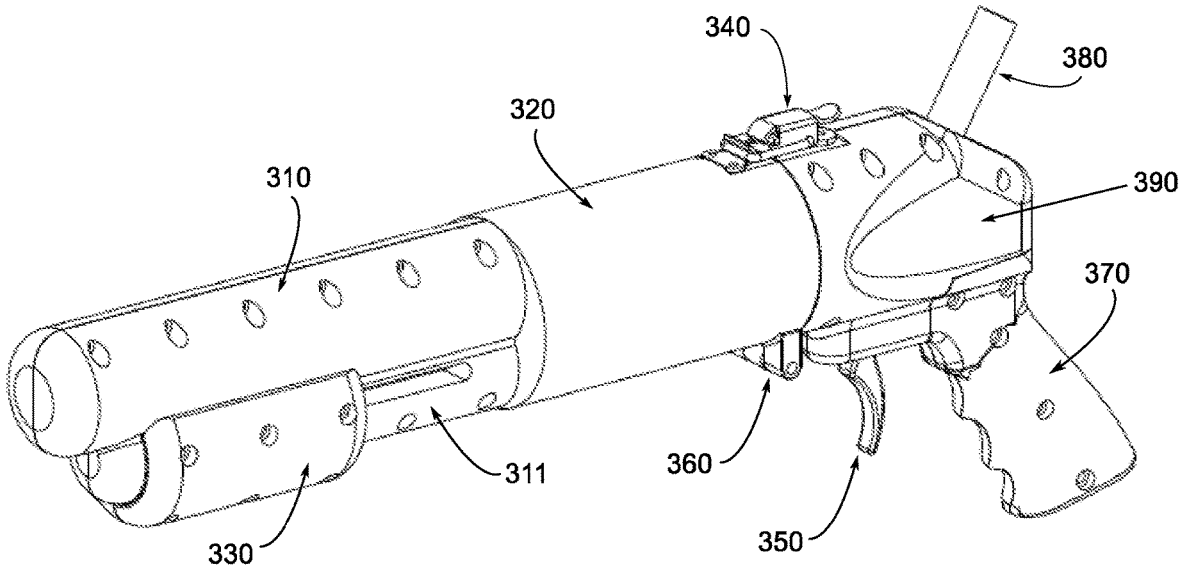
FIG. 3 is a perspective view of an exemplary apparatus according to the present invention in a closed position.

FIG. 3 illustrates one preferred embodiment of a complete apparatus according to the present disclosure. This apparatus is shown in a closed position (as opposed to that shown in FIG. 4 in an open position). This closed position is the position of the apparatus when ready for operation. Here, the full forestock is shown, comprised of the barrel 310 and slide 330 in assembly with the horizontal container receiver 320. The forestock is connected by a hinge 360 to handle assembly 390. As shown, the hinge is closed, causing the forestock to be in line with the handle assembly and is latched in the closed position by closure of clasp 340. Such clasp 340 is exemplary and this latching step could be accomplished by the use of numerous other closures now known or otherwise knowable to those skilled in the art, such as, without limitation, push-button mechanisms or friction closures. The trigger 350 of the trigger assembly is shown, with the full trigger assembly being incorporated into the handle assembly 390. The handle assembly is further exemplified in the present FIG. 3 having a handle 370, stylized in this example to resemble a pistol grip. At the rear, mouthpiece 380 will permit the user of the apparatus to drink the rapidly escaping liquid from a beverage container in the container receiver 320 when such container is pierced by the operation of the assembly.

Added detail is shown in the form of a lower portion 311 of the barrel, which acts as a guide for the sliding operation of the slide 330, internally connected to the first piercer.

Figure 4:
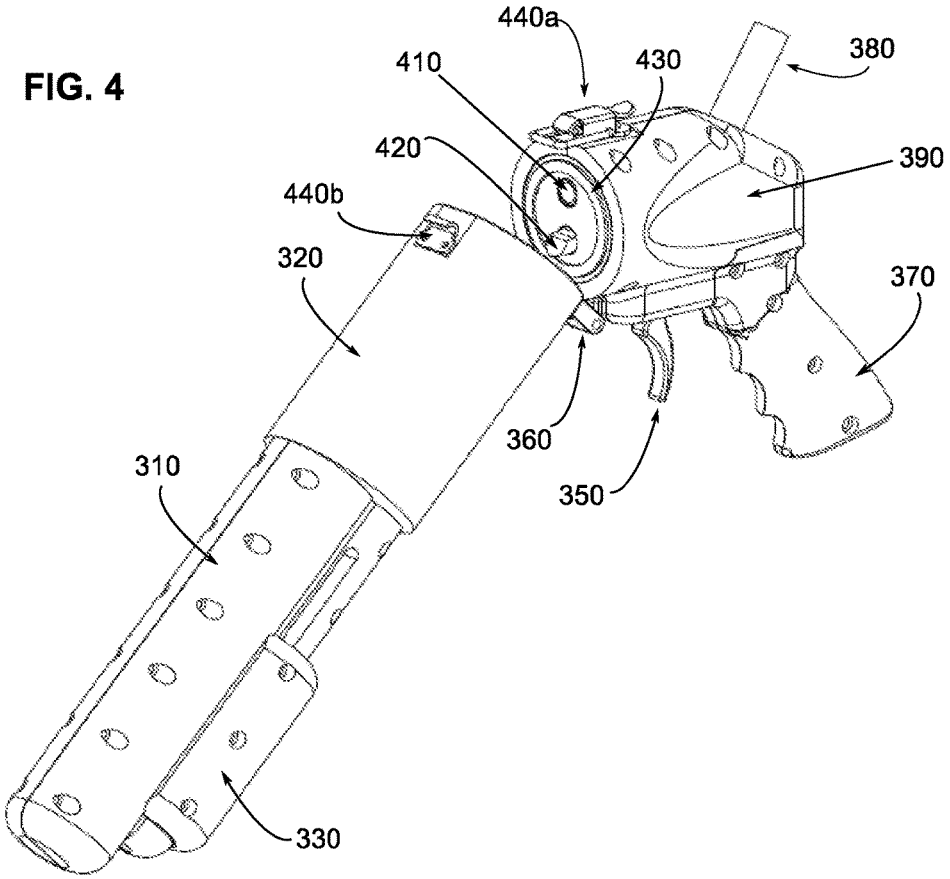
FIG. 4 is a perspective view of an exemplary apparatus according to the present invention in an open position.

FIG. 4 illustrates the same preferred embodiment of FIG. 3 in an open position. As shown, this position of the apparatus permits a user to place a beverage container into the container receiver 320. The apparatus is opened by disengaging the latch portion 440*a* of clasp 340 from the hook portion 440*b* of clasp 340 and operating hinge 360. As above, a forestock portion is shown comprising barrel 310 and slide 330 in connection with container receiver 320. With the clasp 340 disengaged, operation of the hinge 360 allows the user to lower the forestock away from handle 390. This places the container receiver 320 in an open position for receiving a beverage container compatible with the particular embodiment of the apparatus. The exemplary embodiment shown here is designed to accept a canned beverage.

As further described with reference to FIG. 6, detailed below, a sealing disk 610 disposed on the handle body will maintain the beverage container in its position in the container receiver when the apparatus is closed. The addition of a sealing ring 430 around the perimeter of the sealing disk improves closure and resists leakage. The sealing ring 430 may, by way of example, be a square profile O-ring, or other type of gasket, without limiting the use of similar sealing elements, which are well known to those of skill in the art. Closing the apparatus further permits tube 410 and trigger piercer end 420 to be operatively placed in mechanical communication with a beverage container held by the container receiver 320, such that the previously described operation of the trigger can cause the trigger piercer end 420 to puncture the beverage container and, as a portion of the overall operation of the apparatus, as more fully described throughout, the contents of the container may flow through tube 410 to the mouthpiece 380 for rapid consumption by the user. Again, such dispensing for consumption may be accelerated by the user's action of tilting the forestock of the apparatus upward.

FIG. 5 presents a perspective view of an exemplary slide 101 in isolation from the complete assembly of the apparatus. The body of slide 101 is shown optionally comprised of left and right sides 101*a*, 101*b*, assembled to form the slide body. Piercer block 510 is mounted inside slide 101 and first piercer 130 is, in turn, mounted on piercer block 510. An optional fore spring 540 is disposed along the length of the first piercer 130 to aid in returning the slide to its starting position after being operated to puncture the beverage container. It will be noted that fore spring 540 is placed between the pointed tip of first piercer 130 and the piercer block 510, permitting the fore spring 540 to compress when the slide is move toward the container receiver and the spring engages with the outside of a beverage container therein.

The piercer block 540 may be adapted in various ways. For example, in one alternate embodiment, the inner portion of the slide may contain a solid portion across its width, which would act as the piercer block 540 and still permit mounting of the first piercer 130 thereon. As another non-limiting example, the slide body may be manufactured so that its inside depth is less than the length of the first piercer 130, thereby permitting the first piercer 130 to be connected directly to the slide without use of a separate piercer block 540. These examples should not be considered limiting and persons of skill in the art will understand that other designs are possible within the scope of this disclosure.

FIG. 6 illustrates and exemplary handle assembly. As previously discussed with respect to other elements of the apparatus, the handle assembly may be made of various materials and manufactured in various ways. The shown embodiment illustrates the manufacturing of left and right sides 390*a*, 390*b*, which may be joined to comprise the handle assembly and permit the insertion or other placement of the other elements. As shown, a sealing disk 610 is added to act as a termination point for the container receiver, aid in retention of a beverage container, and facilitate a good seal to avoid leakage. This FIG. 6 further illustrates the exit point of trigger piercer end 420 from the handle assembly when the trigger assembly is operated, permitting the trigger piercer end 420 to enter the container receiver and pierce the container therein.

Figure 7:
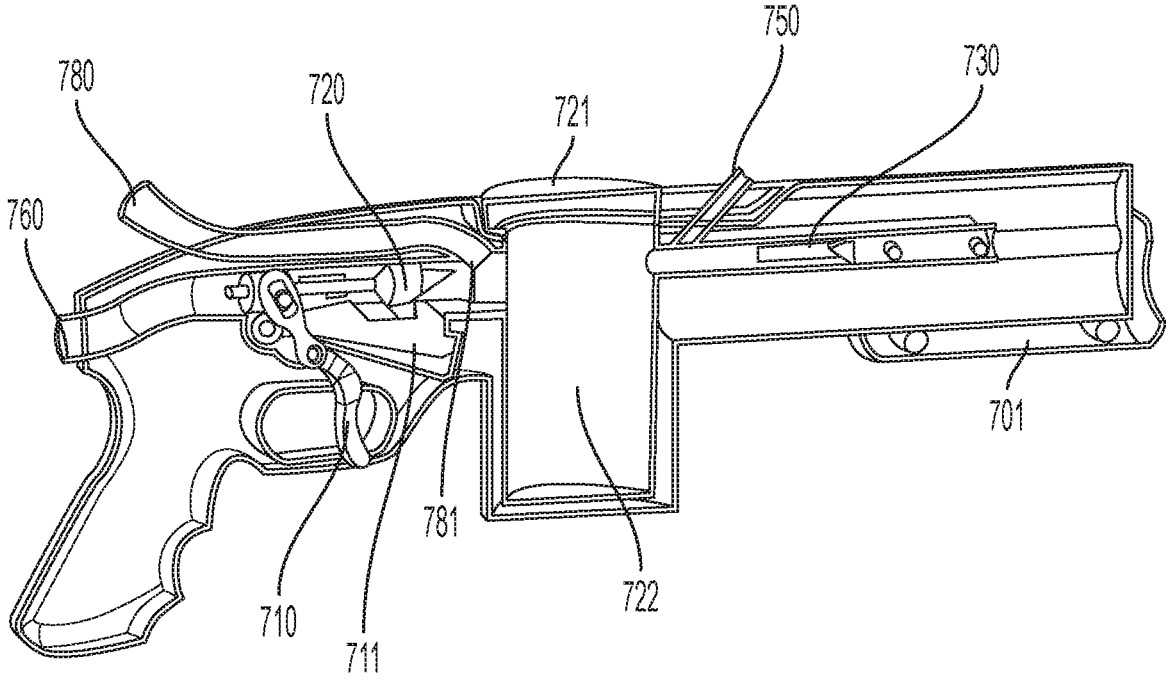
FIG. 7 is a cross-section view of an alternative embodiment of an apparatus according to the present invention.

As will be apparent to one of skill in the art, various embodiments of the disclosed apparatus are possible within the scope of the present disclosure. FIG. 7 illustrates one alternative embodiment, shown in cross-section. It will be noted that the container receiver 722 of this alternate embodiment is arranged to permit the insertion of a beverage container in a vertical position. First piercer 730 remains operable by the manual sliding of slide 701. Trigger piercer 720 is activated by the operation of trigger 710. Further illustrating the numerous options for the functioning of the trigger assembly, piercer retainer 711 is shown engaged with the trigger piercer 720. In the illustrated position, the piercer retainer maintains the trigger piercer 720 in a "cocked" position. Operation of the trigger 710 will release the trigger spring, causing the piercer retainer 711 to disengage from the trigger piercer 720, thereby allowing the trigger spring to decompress and the trigger piercer to forcefully enter the container receiver 722 to pierce a container inserted therein. Beverage flows from the pierced container upon withdrawal of the trigger piercer and enters tube 781 where the beverage may then be consumed by the user via mouthpiece 780. A user may tilt the apparatus to initiate and continue this rapid beverage flow by simply raising the forestock.

Smooth beverage flow is facilitated by the vent 750 which permits air flow in connection with the beverage flow. The illustrated embodiment additionally includes a rear vent 760, further aiding smooth liquid flow.

Also shown in FIG. 7 is the container receiver lid 721. A beverage container is placed in the container receiver 722 by simply opening the container receiver lid 721. Closing the container receiver lid 721 retains the beverage container in place and avoids spillage of the beverage from the container receiver 722 while the user is consuming the beverage. Additional elements may be utilized to improve the seal, such as the O-rings or gaskets previously described herein.

In contrast to the prior-described embodiments, this embodiment does not require the forestock to be separate from or otherwise interrupted in construction from the handle portion. Such illustrates that construction of the various portions of the apparatus body may therefore be integrally formed, such as by molding the entire length in one piece or in full-length cross-section pieces for simple assembly by snapping, screwing, or otherwise fastening the sections together.

The system and method, as illustrated by the foregoing described embodiments, and as further described herein, provides a Rapid Beverage Consumption Device. The result is that the present device operates to allow a user entertainment in the form of "shotgunning" a beverage in a method that overcomes the shortcomings of the prior art, including by facilitating consistent dual puncturing of a beverage container, without direct exposure of a user to sharp piercing elements, ventilated flow of the beverage contents via a predetermined path, and leak resistance for the avoidance of spillage, thereby reducing waste and reducing the likelihood of the user getting wet.

What is claimed is:

1. A rapid fluid dispensing apparatus comprising:

a. A forestock, said forestock further comprising:
   i. A barrel;
   ii. A slide, placed in non-stationary communication with said barrel, so as to permit the slide to move along at least a portion of said barrel in a direction co-axial thereto;
   iii. A first piercer attached by a first end to the slide, said first piercer having a pointed second end, and said first piercer arranged such that said first end and said pointed second end are substantially co-axial to the direction of movement of said slide and said second pointed end is in the direction of a container receiver suitable for receiving a beverage container, said pointed second end of said first piercer arranged such that it may be extended forcibly into said container receiver to puncture a beverage container therein;

b. A handle assembly;

c. A second piercer disposed inside said handle assembly in a non-stationary mechanical attachment thereto;

d. Said handle assembly in mechanical communication with said container receiver such that said second piercer may be moved forcibly into said container receiver for puncturing a beverage container therein;

e. A mouthpiece;

f. An internal flowpath providing fluid communication between said container receiver and said mouthpiece g. At least one vent.

2. The rapid fluid dispensing apparatus of claim 1, further comprising a trigger assembly for operation of said second piercer, said trigger assembly comprising a trigger hingedly connected to said second piercer and a first spring arranged such that operation of said trigger causes said first spring to decompress for said purpose of moving said second piercer forcibly into said container receiver.

3. The rapid fluid dispensing apparatus of claim 1, said handle assembly further comprising a pistol grip.

4. The rapid fluid dispensing apparatus of claim 1 wherein said forestock is hingedly connected to said handle assembly such that operation of said hinge to its open position interrupts said mechanical communication of said handle assembly and said container receiver sufficiently to permit insertion of a beverage container into said container receiver and operation of said hinge to its closed position re-establishes said mechanical communication of said handle assembly and said container receiver.

5. The rapid fluid dispensing apparatus of claim 4 further comprising a closure element for retaining said hinge in its closed position.

6. The rapid fluid dispensing apparatus of claim 5 wherein said closure element is a latch.

7. The rapid fluid dispensing apparatus of claim 5 wherein said closure element is a frictional closure.

8. The rapid fluid dispensing apparatus of claim 1 wherein said handle assembly further comprises a sealing disk.

9. The rapid fluid dispensing apparatus of claim 8 wherein said handle assembly further comprises a sealing ring.

10. The rapid fluid dispensing apparatus of claim 8 wherein the longitudinal axis of said container receiver is substantially perpendicular to the radial axis of said sealing disk when said forestock and said handle assembly are in operable physical connection.

11. The rapid fluid dispensing apparatus of claim 1 wherein said container receiver it substantially perpendicular to said forestock.

12. The rapid fluid dispensing apparatus of claim 11 further comprising a container receiver lid.

13. The rapid fluid dispensing apparatus of claim 1 further comprising a second spring, wherein said first piercer is longitudinally disposed through the coil of said second spring such that said second spring is between the point of attachment of said first end of said first piercer to said slide and said pointed second end of said first piercer.

14. The rapid fluid dispensing apparatus of claim 1 wherein said slide further comprises a piercer block inside said slide wherein said piercer block is the point of attachment of said first end of said first piercer to said slide.

15. The rapid fluid dispensing apparatus of claim 1 further comprising at least one slide spring in mechanical communication with said slide such that said at least one slide spring is compressed when said slide is moved longitudinally along said barrel in the direction opposite said container receiver and decompression of said at least one slide spring will cause said extending forcibly into said container receiver of said pointed second end of said first piercer.

* * * * *